US006402524B2

(12) United States Patent
Wurm et al.

(10) Patent No.: US 6,402,524 B2
(45) **Date of Patent: *Jun. 11, 2002**

(54) DATA TRANSFER SYSTEM

(75) Inventors: Dieter Wurm, Kirchhundem; Klaus Zerbs, Schmallenberg; Elmar Koch, Eslohe, all of (DE)

(73) Assignee: Tracto-Technik Paul Schimdt Spezialmaschinen, Lennestadt (DE)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/168,805

(22) Filed: Oct. 8, 1998

(30) Foreign Application Priority Data

| | | |
|---|---|---|
| Oct. 14, 1997 | (DE) | 197 45 368 |
| Dec. 23, 1997 | (DE) | 197 57 512 |
| May 4, 1998 | (DE) | 198 19 626 |

(51) Int. Cl.[7] ..... H01R 41/00
(52) U.S. Cl. ..... 439/10; 439/32
(58) Field of Search ..... 439/32, 33, 190, 439/191, 192, 193, 194, 195, 13, 28, 1, 2, 9, 10, 11, 164, 20, 21, 22, 23, 24, 25, 26, 27, 29, 30, 275, 201; 166/65.1, 66.7, 66.4; 367/85

(56) References Cited

U.S. PATENT DOCUMENTS

| | | | | | |
|---|---|---|---|---|---|
| 1,794,291 | A | * | 2/1931 | Hobart | 310/241 |
| 2,224,439 | A | * | 12/1940 | Lee | 173/15 |
| 2,643,087 | A | * | 6/1953 | Ogorzaly et al. | 439/10 |
| 2,681,564 | A | * | 6/1954 | Jeromson, Jr. et al. | 439/28 |
| 3,087,038 | A | * | 4/1963 | Bethke | 439/10 |
| 3,793,606 | A | * | 2/1974 | Wilson | 439/10 |
| 4,399,877 | A | | 8/1983 | Jackson et al. | |
| 4,560,219 | A | * | 12/1985 | Chapelot | 439/272 |
| 4,600,062 | A | * | 7/1986 | Teng | 175/322 |
| 4,606,603 | A | * | 8/1986 | Cairns | 350/96.21 |
| 4,660,910 | A | * | 4/1987 | Sharp et al. | 439/194 |
| 4,676,563 | A | * | 6/1987 | Curlett et al. | 439/194 |
| 4,698,027 | A | * | 10/1987 | Vandame | 439/271 |
| 4,866,214 | A | | 9/1989 | Kinnan | |
| 4,997,384 | A | * | 3/1991 | Godfrey et al. | 439/190 |
| 5,141,051 | A | * | 8/1992 | Lenhart | 166/65.1 |
| 5,425,645 | A | * | 6/1995 | Skovdal et al. | 439/23 |
| 5,557,975 | A | * | 9/1996 | Crane et al. | 73/862 |
| 5,692,576 | A | | 12/1997 | Hesse et al. | |
| 5,740,127 | A | * | 4/1998 | Van Steenwyk et al. | 367/85 |
| 5,772,514 | A | * | 6/1998 | Moore | 464/20 |
| 5,820,416 | A | * | 10/1998 | Carmichael | 439/668 |
| 5,823,257 | A | * | 10/1998 | Peyton | 166/65.1 |
| 5,833,015 | A | | 11/1998 | Hesse et al. | |

FOREIGN PATENT DOCUMENTS

| | | |
|---|---|---|
| WO | WO 95/22679 | 8/1995 |

OTHER PUBLICATIONS

European Patent Office Search Report dated Feb. 12, 2002 regarding European Patent No. EP 98 11 9278 (4 pages).

* cited by examiner

*Primary Examiner*—P. Austin Bradley
*Assistant Examiner*—Ross Gushi

(57) ABSTRACT

A system for transfer of data or electric current for a steerable horizontal boring machine for laying and destructive replacement of supply lines, which is suitable both for percussive and for rotary drilling operation and permits reliable and problem-free use of a cable connection between a consumer or sensor and a power supply or a data utilising unit, preferably comprises three elements (machine adapter, string adapter, transmitter adapter) for connecting the cable.

17 Claims, 5 Drawing Sheets

DATA TRANSFER SYSTEM

The invention relates to a system for transfer of data and/or electric current for a steerable horizontal boring machine for laying and destructive replacement of supply lines.

Such systems are used in the trenchless laying of supply lines, for example for transfer of measuring data from a measuring instrument located in the drill head to an external data utilising unit. The transfer usually takes place via a radio connection, as described in German patent specification 44 38 934. For this purpose in known devices inclination sensors, roll sensors and temperature detectors are fitted in the drill head, the signals from which are utilised outside the underground bore. Particular importance attaches to the determination by means of a locating transmitter of the position of the steerable drill head as it progresses underground.

All the sensors and other consumers of electricity require a current supply which is provided by accumulators fitted in the drill head or through an electric cable leading to an external power supply. Accumulators have the disadvantage of only being usable for a limited period of time, which can give rise to considerable problems if the transmitter fails during a boring operation because the accumulator is flat and the drill head can no longer be located.

The supply of current through a cable, as known from German Offenlegungsschrift 196 13 788, avoids the problem of time-limited utility. In this device a measuring instrument for measuring the tensile force between an expanding head and a pipe that is being pulled in is connected by a cable running parallel to the pipe being pulled in or to the drill string to a control box located on the surface of the ground.

In German Utility Model specification 88 09 108 an elongated body to be driven into the ground is described in which the electrical supply lines run in the pipe jacket. Rotation of the pipe must be avoided in order to avoid twisting the cable.

In all cases of connection by cable there is the problem that the boring machine is driven into the ground one element at a time by means of lengths of rod or lengths of pipe. This necessitates stepwise connection of the elements, and thus also of the lengths of cable. The respective points of connection can be subjected to harmful axial loads, particularly in the case of percussive boring, while in the case of rotary boring twisting of the cable must be avoided.

The object of the invention is to provide a system for transfer of signals or electric current for a steerable horizontal boring machine which avoids the above-mentioned disadvantages and permits reliable and problem-free use of a cable connection between a consumer or sensor and a source of current or a data utilising unit.

To achieve this object, the invention provides a system comprising various adapters as set forth in the independent claims herein. The system or the adapters is or are suitable both for percussive and for rotary boring operations, and preferably comprise three elements (drive adapter, rod adapter, consumer adapter) for connection of the cable line.

The signal transfer between the rotatable string and data utilising unit or between a power source and the rotatable string can be effected by means of a drive adapter having connecting means which are stationary relative to the string. It is particularly advantageous if a slip ring connection includes an axially slidable slip ring and/or current collector, in order to neutralise axial accelerations of the drill string such as may occur when drilling in hard rock or when using a striking mechanism, and thus prevent damage to the slip ring connection.

In the case of rotary operation of the boring machine the drill string rotates, and with it the slip ring fitted on the string and the cable inside the string. The current collector connected to the power source and/or to the data utilising unit is in contact with the slip ring, but does not transmit any rotary movement, since it is fixed on the drive side. Twisting of the cable is thus ruled out.

The individual lengths of the string can include internal electric leads with string adapters for connection of the leads, which can be automatically connected, together with the string lengths, by having the ends of the leads fixed in the string head and aligned so that making a connection between two string lengths also results in connection of the ends of the leads.

The cable can run axially in the drill string length and emerge centrally from the string head.

The electrical connections, especially the connection between the consumer located in the boring machine and the cable, can include connecting elements (consumer adapters) which permit relative axial movement between the connected elements without transmission of axial forces. This connection of cable elements or of electrical consumer and a cable element makes problem-free use of the boring machine in hard rock or with percussion drive possible without putting a strain on the electrical connection. In this way, together with damping of the transmitter or sensor by means of suitable damping elements in the sensor housing, an optimum transfer system for rotary and percussive boring operation is provided.

The invention will now be described in more detail, by way of example, with reference to embodiments illustrated in the drawings, in which.

Figure 1:
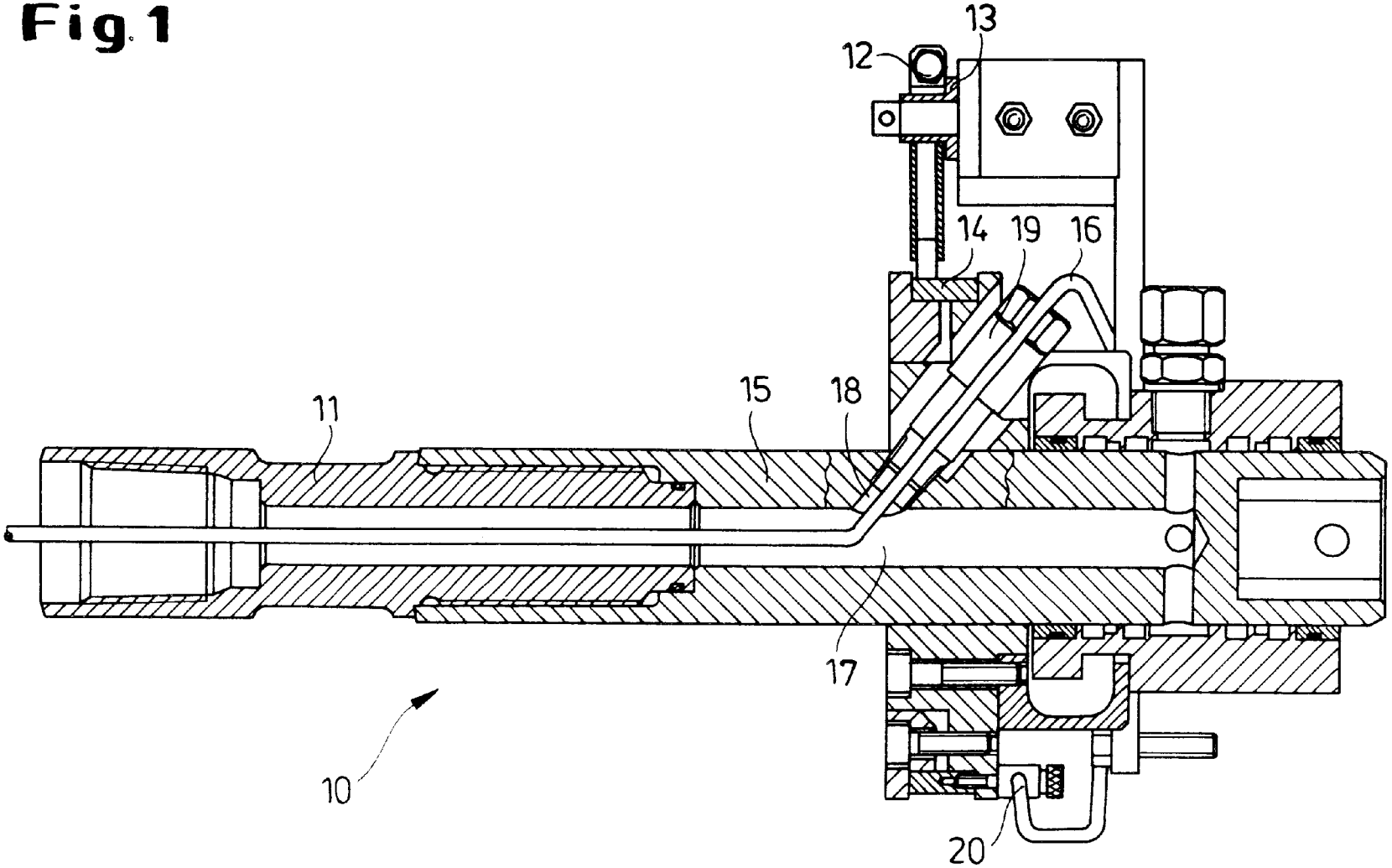
FIG. 1 shows a drive adapter in accordance with the invention.
Figure 2:
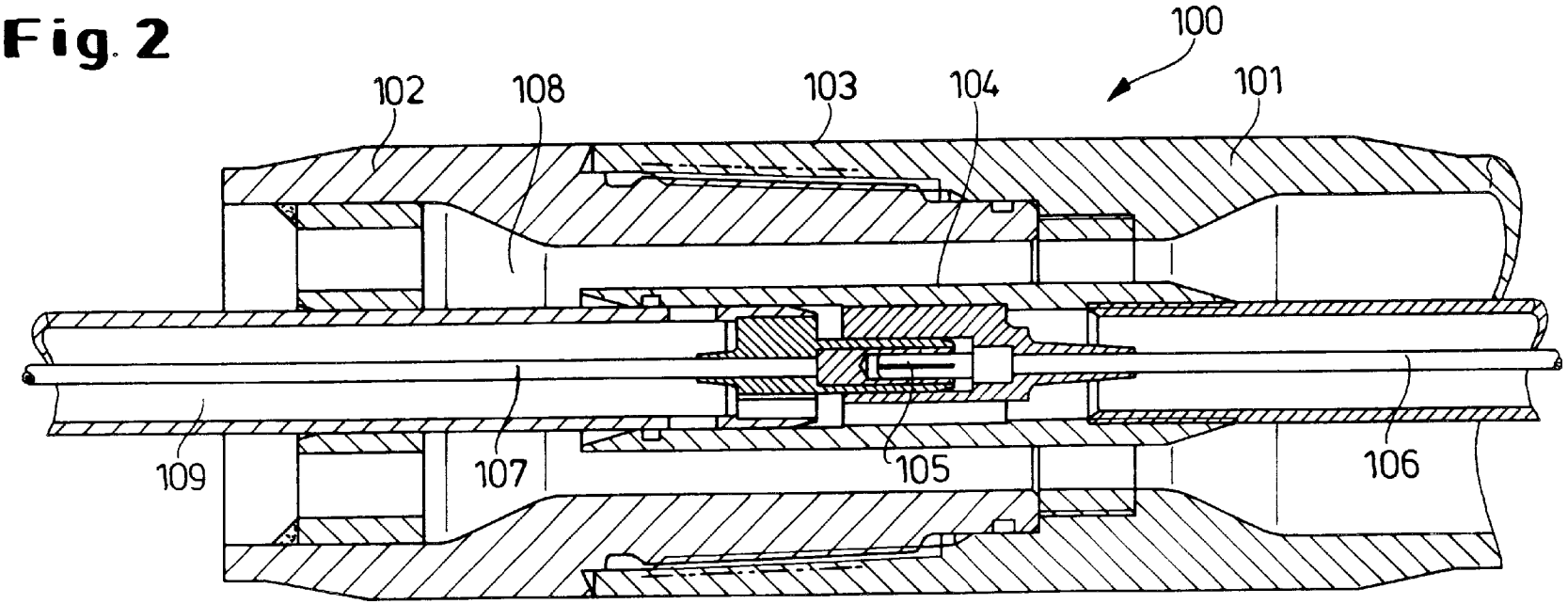
FIG. 2 shows a section through a string adapter in accordance with the invention.
Figure 4:
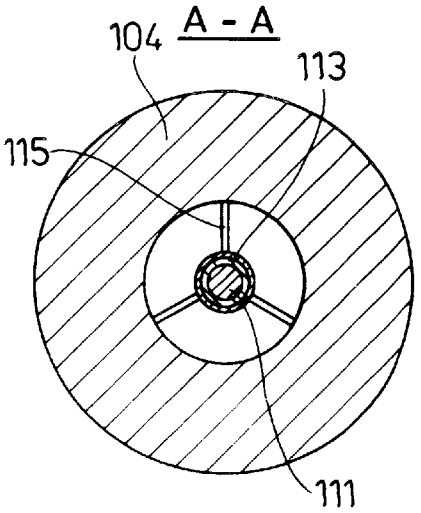
FIG. 4 shows a section through the string head of FIG. 3.
Figure 3:
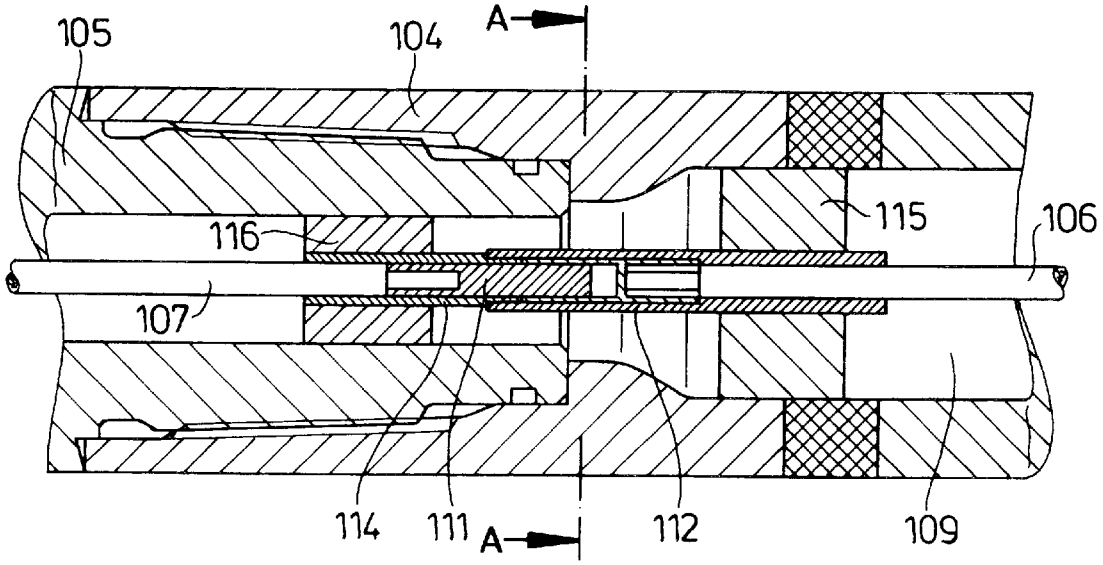
FIG. 3 shows a section through a string adapter in the string head, with an annular gap for a medium.
Figure 5:
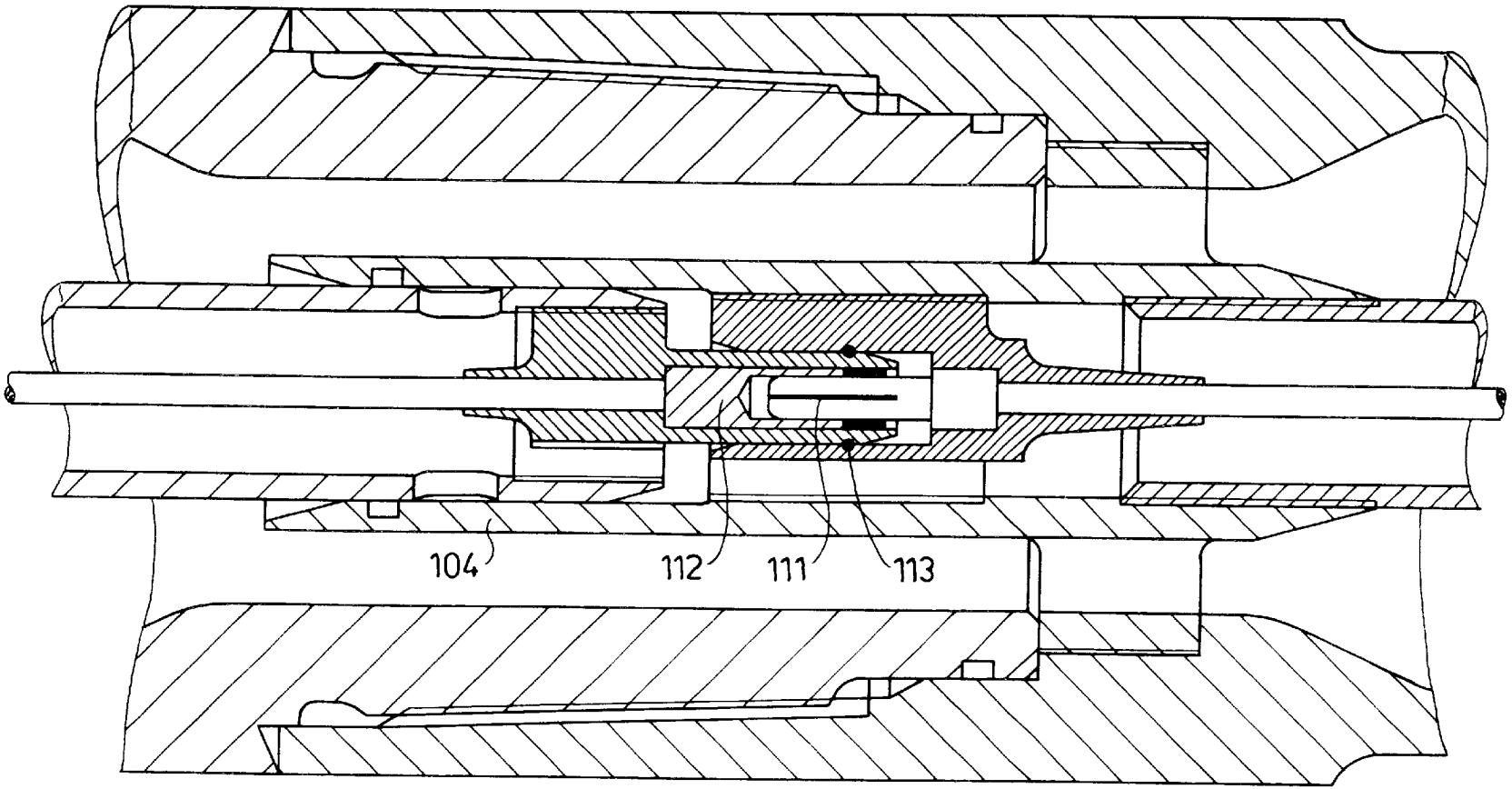
FIG. 5 shows a detail of the plug in the string adapter of FIG. 2.
Figure 6:
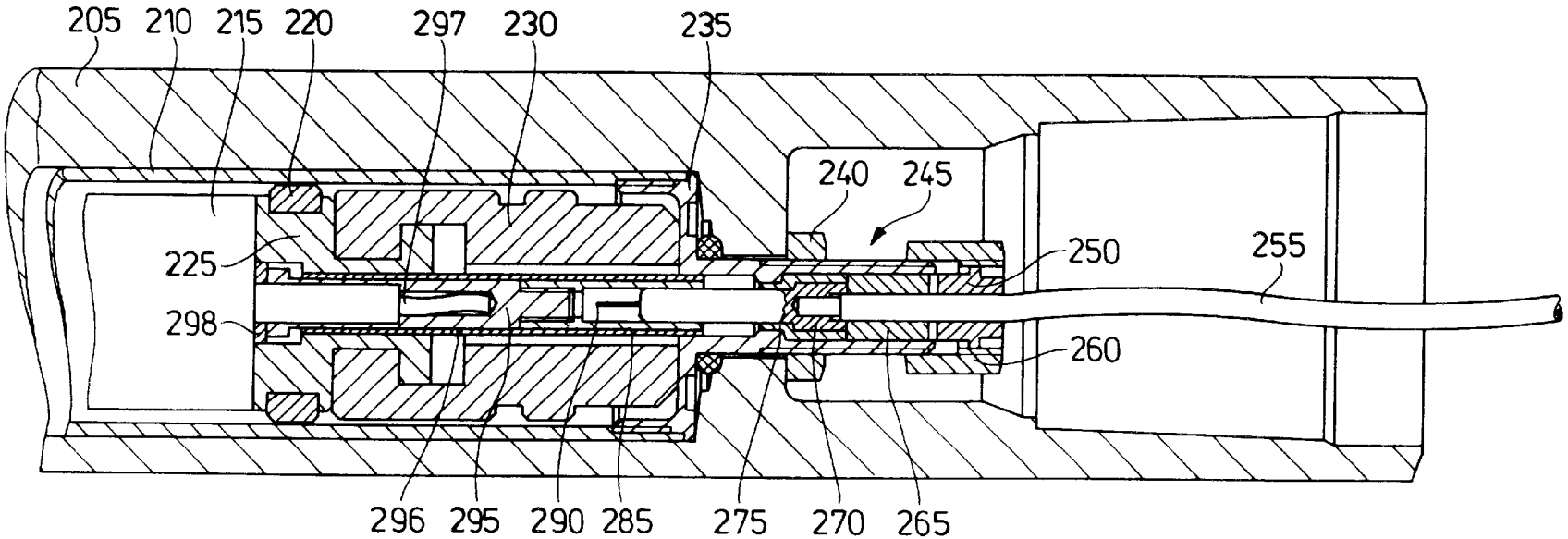
FIG. 6 shows a section through a consumer adapter in accordance with the invention.

The system for transfer of electrical signals and electric current for a steerable horizontal boring machine comprises a drive adapter 10, a string adapter 100 and a consumer adapter 200.

The drive adapter 10 serves to transfer the electrical signals from the rotating drill string 11 to a stationary current collector 12 connected to a data utilising unit (not shown). The current collector 12 is fitted on a holder 13 so as to contact a slip ring 14 which is fitted on a string connector 15 and rotates about the axis of the string together with this connector and the string 11.

A cable 16 emerges centrally from the string 11 and enters a central bore in the string connector 15. The cable 16 is led out of the drive adapter 10 through an outlet opening 18 in the wall of the string connector 15. The outlet opening 18 is sealed by means of a sealing screw connection 19 to prevent escape of drilling fluid. The cable 16 is led from the sealing screw connection 19 to a slip ring connector 20. The slip ring connector 20 is in direct contact with the slip ring 14 and rotates therewith around the axis of the string.

The slip ring 14 is mounted axially slidably on the string connection 15, and its width is made such that the contact with the current collector 12 is maintained even when axial displacement of the slip ring occurs.

The string adapter 100 includes, in the region of the string connection 103, a string socket 104 with electric plugs 105. The plugs 105 connect inside the string lengths 101, 102 with electrical leads 106, 107 (coaxial cable) running along their axis. The string lengths 101, 102 are also provided with various passages (media space) for various media. The electric plug 105 is sealed from the passages 108, 109 which contain liquid media. The media may be used to transfer pressure pulses. The electrical plug connection comprises a plug 111 and a socket 112, which engage sliding one inside the other on making the connection and thereby form a secure electrical contact. The engagement may be in form of a swivel coupling.

The electric plugs are sealed from their surroundings by a seal 113 and a seal 114. The plug connections or cables are fixed by means of cable clamps 115, 116 so as not to prevent the flow of the media in the passages 108, 109. The additional annular passage 109 permits the separate transport of two different media. The string lengths preferably have an external screw thread on one side and an internal screw thread on the other side. The string strand can be made up of several individual strings.

On connecting the individual string lengths, for example using an automatic string magazine, the plugging together of the cable elements takes place automatically as part of the string connection.

Therefore if, for example, the drill head has travelled some distance and its position needs to be determined, a measuring instrument located in the region of the drill head can be connected to a power source by connecting the string head (11 in FIG. 1) to the machine or data utilising unit or power source.

In the case of consumer adapters, a transmitter 215 is fitted in a cylindrical chamber 210 in the housing 205 of a boring machine (not shown). The transmitter 215 has a cylindrical housing of which the external diameter is smaller than the internal diameter of the chamber 210. By means of slip rings 220 the transmitter 215 is mounted axially slidably in the chamber 210. The axial movement of the transmitter 215 within the cylindrical chamber 210 is buffered by means of dampers 230 fitted in a damper holder 225 and bearing against a metal plug 235.

The transmitter is grounded by means of the electrically conductive damper frame 225 connected to the transmitter 215. The connection is formed through a slidably mounted grounding spring 296, which is supported on the metallic stopper plug 235, and from there to the ground surrounding the housing.

The rear region of the transmitter 215 shown is provided with connecting elements 290, 295, 296, 297, 298 for connection of the transmitter to a power source and/or to a data utilising unit via a feeder cable 255.

In detail, these connecting elements are constructed in such a way that a cable 297 emerging from the transmitter is screwed by means of a threaded crimp connector 295 to a sliding bushing 290. The sliding bushing 290 and the crimp connector 295 are supported by thrust rings 285 and 298 inside the cylindrical chamber and are insulated from the damper holder 225.

The sliding bushing 290 is formed to receive a plug 270 which is fitted on to the connecting cable 255. A plug frame 245 serves to fix the plug 270 in the boring machine housing. Since the plug frame 245 is grounded, the plug is insulated from the housing by an insulating bushing 275.

The string end of the plug is usually exposed to a drilling fluid which is passed under pressure from the string past the transmitter to an outlet nozzle on the drill head. The transmitter is therefore sealed by means of a sealing element 265 against penetration by the drilling fluid.

The sealing element 265 is crimped to the string end of the plug 270 by means of a thrust washer 250 and a clamping nut 260.

To connect the transmitter 215 to the power source and/or a data utilising unit the plug 270 is introduced into the sliding bushing 290. The diameters of the plug 270 and of the sliding bushing 290 are selected so as to bring about on the one hand a secure electrical contact and on the other hand axial displaceability of the plug 270 relative to the sliding bushing 290. This axial displaceability simultaneously results in relative axial displaceability between the transmitter 215 and the connecting cable 255.

Especially in the case of percussive boring operation a damped axial excursion of the transmitter 215 occurs, but with the device in accordance with the invention this only leads to a relative displacement of the plug 270 within the sliding bushing 290, without any axial forces being transmitted to the connecting cable 255.

The plug 270 and the sliding bushing 290 can easily be replaced in case of wear. To replace the plug 270 all that is needed is to undo the clamping nut 260 and the securing nut 240.

To replace the sliding bushing it is unscrewed from the threaded crimping element 295, and can simply be replaced by a new sliding bushing with corresponding screw threads.

On the other hand dismounting of the transmitter 215 is also possible without having to undo the connecting cable 255. In particular, the connection to the string and thereby also the fluid space with the drilling fluid remains closed even when the transmitter 215 has been dismounted, since the plug device 240, 260, 265, 270 does not have to be undone in order to dismount the transmitter Likewise replacement of the connecting cable 255 is possible without the transmitter 215 having to be removed from its housing, as was formerly necessary.

What is more, the grounding of the transmitter, which is effected for example through a spring, can also be slidably mounted, so that here, too, no transmission of force occurs if the transmitter 215 is displaced axially on the grounding element.

The consumer adapter in accordance with the invention thus allows electrical consumers, such as for example a locating transmitter, to be used in a percussive or occasionally percussive boring machine without any problems.

Overall the system for transfer of electrical signals or electric current, and its elements, singly or in combination, provides a reliable possibility of conductive connection between sensors in the drill head and external processing instruments and between all kinds of consumers inside the borehole and a power source.

What is claimed is:

1. A system for transfer of data or electric current for a steerable horizontal boring machine for laying and/or destructive replacement of supply lines comprising a drill head, a drive, a string having a longitudinal axis, a consumer, a drive adapter, a string adapter and a consumer adapter, wherein the drive adapter includes: a string connector for connecting to the string, an electrical connecting element which is carried on the string connector and which is secured for rotation with the string connector and is movable relative to the string connector along the longitudinal axis of the string, and a current collector which is stationary with respect to a data utilising unit or power source, the electrical connecting element and the current collector being mounted to allow axial displacement therebetween along the longitudinal axis of the string without interruption of data or electrical current, the axial displacement being sufficient to accommodate percussive boring;

the string adapter is in the form of a length of drill string having a string head at each end and an internal electrical lead, the ends of the leads being fixed in the string head of the string length and being aligned such that connecting two string lengths result in automatic connection of the leads; and the consumer adapter is provided with a string-side connecting element and a consumer-side connecting element connected thereto, the connecting elements allowing relative axial movement between the electrical consumer and the connecting cable along the longitudinal axis without interruption of data or electric current, the axial movement being sufficient to accommodate percussive boring when the electrical consumer and the connecting cable are engaged.

2. An adapter for transfer of data or electric current between a length of string of a steerable horizontal boring machine for laying and/or destructive replacement of supply lines and a data utilising unit or a power source, comprising: a string connector for connecting to the string length, an electrical connecting element which is secured for rotation with the string connector and which is movable longitudinally with respect to the string connector, and a current collector which is in contact with the electrical connecting element and is stationary with respect to the data utilising unit or the power source;

wherein the electrical connecting element and the current collector are mounted to allow axial displacement therebetween along a longitudinal axis of the string without interruption of data or electric current, the axial displacement being sufficient to accommodate percussive boring.

3. An adapter as claimed in claim 2, wherein the electrical connecting element is in the form of a slip ring.

4. An adapter as claimed in claim 2, wherein the string length has a string head at each end and an internal electric lead, wherein the ends of the lead are fixed in the string head and are aligned such that connecting two string lengths results in automatic connection of the leads.

5. An adapter as claimed in claim 4, wherein the lead runs axially in the drill string length and lies centrally in the string head.

6. An adapter as claimed in claim 4, wherein the lead is a coaxial cable or a cable with an insulated litz wire.

7. An adapter as claimed in claim 4, wherein the electric lead runs in an inner pipe with a media space and is sealed off from this space.

8. A method for trenchless earth boring using an adapter as claimed in claim 7, employing the internal pipe or a medium present therein to transfer pressure pulses.

9. An adapter as claimed in claim 4, wherein the string length is provided with a further media space between its outer jacket and the inner pipe.

10. An adapter as claimed in claim 9, wherein the leads which are fixed in the string length have a coupler socket at one end and a coupler plug at the opposite end.

11. An adapter as claimed in claim 10, wherein the coupler socket and the coupler plug of the leads are in sliding contact when the string is connected up and as it is being connected.

12. An adapter as claimed in claim 10, wherein the couplings are in the form of swivel couplings.

13. An adapter as claimed in claim 4, wherein the sealing element is fitted between the coupler socket and the coupler plug.

14. An adapter as claimed in claim 4, wherein a string strand is made up of several individual string lengths.

15. A horizontal boring system for attachment between a consumer associated with a horizontal boring head and a stationary collector associated with a data utilizing unit or power source, the system comprising:

a plurality of string lengths, each string length including a string head at each end and an electrical conductor extending through the length and terminating in the string heads, the string lengths being connectable head-to-head to define a string having a longitudinal axis;

a drive adapter including:

(a) a string connector for connection to one end of a string length, (b) an electrical connecting element secured to the string connector for rotation with the string connector, the electrical connecting element being slidably movable longitudinally on the string connector, and (c) a current collector stationary with respect to a data utilizing unit or a power source, the electrical connecting element and the current collector being mounted to allow relative axial displacement therebetween along a longitudinal axis of the string without interruption of data or electrical current, the axial displacement being sufficient to accommodate percussive boring;

a string adapter for connecting the electrical leads of string lengths when joined, the string adapter including a receiving member located in the head of one string length to be connected and an inserting member located in the head of another string length to be connected, the receiving member including one of an electrically conductive plug and electrically conductive socket sized to slidably receive the electrically conductive plug and the inserting member including the other of the electrically conductive plug and socket, the electrically conductive plug and socket being connected to the lead in the respective string length;

the receiving and inserting members being aligned in the respective heads such that the receiving member slidably receives the inserting member and the electrically conductive socket slidably receives the electrically conductive plug upon connection of the string lengths, resulting in automatic connection of the leads when two string lengths are connected, the electrically conductive plug and socket allowing relative axial movement of the two string lengths to an extend sufficient to accommodate percussive boring without disrupting the electrical connection therebetween when the string lengths are connected; and a consumer adapter for connecting the consumer to the conductor in a connected string length, the adapter being provided with a string-side connecting element and a consumer-side connecting element, one of the connecting elements being a conductor plug and the other of the connecting elements being a conductor socket sized to slidably receive the conductor plug, the conductor plug and socket also allowing relative axial movement between the electrical consumer and the connecting lead along the longitudinal axis without interruption of data or electric current, the axial movement being sufficient to accommodate percussive boring when the electrical consumer and the connecting lead are engaged.

16. The system in accordance with claim 15 in which one of the electrical connecting element and the current collector of the drive adapter is a slip ring of electrically conductive material and the other is a slip ring contact, the slip ring having a width in the axial direction sufficient to allow axial displacement relative to the slip ring contact as a result of percussive boring without breaking contact with the slip ring contact.

17. The system of claim 15 in which an electrical conductor extends longitudinally through the string connector, outwardly though an aperture in a side wall of the string connector and to the electrical connecting element, said aperture being sealed to prevent leakage of any fluid within the string connector.

* * * * *